US008313541B2

(12) United States Patent
Maehling et al.

(10) Patent No.: US 8,313,541 B2
(45) Date of Patent: Nov. 20, 2012

(54) MIXTURE OF POLAR OIL-SOLUBLE NITROGEN COMPOUNDS AND OIL-SOLUBLE ALIPHATIC COMPOUNDS FOR LOWERING THE CLOUD POINT IN MIDDLE DISTILLATE FUELS

(75) Inventors: Frank-Olaf Maehling, Mannheim (DE); Jan Strittmatter, Mannheim (DE); Heinrich Lubojanski, Soergenloch (DE); Andreas Minke, Roedersheim-Gronau (DE); Uwe Rebholz, Mehlingen (DE); Alex J. Attlesey, Morristown, NJ (US); Stephan B. Lopes, II, Carneys Point, NJ (US)

(73) Assignee: BASF SE, Ludwigshafen (DE)

( * ) Notice: Subject to any disclaimer, the term of this patent is extended or adjusted under 35 U.S.C. 154(b) by 297 days.

(21) Appl. No.: 12/754,152

(22) Filed: Apr. 5, 2010

(65) Prior Publication Data

US 2010/0251604 A1 Oct. 7, 2010

Related U.S. Application Data

(60) Provisional application No. 61/167,170, filed on Apr. 7, 2009.

(51) Int. Cl.
*C10L 1/18* (2006.01)
*C10L 1/22* (2006.01)

(52) U.S. Cl. ..... 44/331; 44/408; 44/418; 44/340; 44/351; 44/352

(58) Field of Classification Search ..... 44/331, 44/408, 418, 340, 351, 352
See application file for complete search history.

(56) References Cited

U.S. PATENT DOCUMENTS

| | | | | |
|---|---|---|---|---|
| 2009/0082599 | A1 | 3/2009 | Burkhardt et al. | |
| 2009/0188159 | A1* | 7/2009 | Eisenbeis et al. | 44/308 |
| 2009/0307964 | A1 | 12/2009 | Maehling et al. | |
| 2010/0016484 | A1 | 1/2010 | Matos et al. | |
| 2010/0293842 | A1 | 11/2010 | Kasel et al. | |

FOREIGN PATENT DOCUMENTS

| | | | |
|---|---|---|---|
| DE | 198 48 621 | A1 | 4/2000 |
| EP | 0 413 279 | A1 | 2/1991 |
| EP | 1 746 147 | A1 | 1/2007 |
| EP | 1 801 187 | A2 | 6/2007 |
| EP | 1 801 188 | A2 | 6/2007 |
| WO | WO 03/042336 | A2 | 5/2003 |
| WO | WO 2007/131894 | A2 | 11/2007 |
| WO | WO 2007/147753 | A2 | 12/2007 |
| WO | WO 2009/060057 | A2 | 5/2009 |

OTHER PUBLICATIONS

U.S. Appl. No. 13/101,426, filed May 5, 2011, Maehling, et al.
U.S. Appl. No. 61/167,170, filed Apr. 7, 2009, Mahling.
U.S. Appl. No. 61/060,848, filed Jun. 12, 2008, Maehling.
International Search Report issued May 27, 2010, in PCT/EP2010/054145.
U.S. Appl. No. 13/176,317, filed Jul. 5, 2011, Maehling, et al.
U.S. Appl. No. 13/432,554, filed Mar. 28, 2012, Garcia Castro, et al.

* cited by examiner

*Primary Examiner* — Cephia D Toomer
(74) *Attorney, Agent, or Firm* — Oblon, Spivak, McClelland, Maier & Neustadt, L.L.P.

(57) ABSTRACT

The use of a mixture comprising (A) 5 to 95% by weight of at least one oil-soluble polar nitrogen compound which can interact with paraffin crystals in middle distillate fuels under cold conditions, and (B) 5 to 95% by weight of at least one oil-soluble aliphatic compound with an alkyl or alkenyl chain having at least 8 carbon atoms, obtainable from aliphatic mono- or dicarboxylic acids having 4 to 300 carbon atoms or derivatives thereof with mono- or polyamines or with alcohols, for lowering the cloud point in middle distillate fuels which, before the addition of additives, have a CP of −8.0° C. or lower by at least 1.5° C. compared to the unadditized middle distillate fuel at a dosage of the mixture of 50 to 300 ppm by weight, with no simultaneous deterioration in the response behavior for the lowering of the cold filter plugging point on addition of cold flow improvers.

16 Claims, No Drawings

MIXTURE OF POLAR OIL-SOLUBLE NITROGEN COMPOUNDS AND OIL-SOLUBLE ALIPHATIC COMPOUNDS FOR LOWERING THE CLOUD POINT IN MIDDLE DISTILLATE FUELS

The present invention relates to the use of a mixture comprising (A) 5 to 95% by weight of at least one oil-soluble polar nitrogen compound which is different from component (B) and is capable of interacting with paraffin crystals in middle distillate fuels under cold conditions, and (B) 5 to 95% by weight of at least one oil-soluble aliphatic compound comprising at least one straight-chain or branched alkyl or alkenyl chain having at least 8 carbon atoms, obtainable by reacting an aliphatic mono- or dicarboxylic acid having 4 to 300 carbon atoms or derivatives thereof with mono- or polyamines or with alcohols, for lowering the cloud point ("CP") in middle distillate fuels which, before the addition of additives, have a CP of −8.0° C. or lower by at least one 1.5° C. compared to the unadditized middle distillate fuel at a dosage of the mixture in the range from 50 to 300 ppm by weight, the CP values each being determined in the unsedimented middle distillate fuel, with no simultaneous deterioration in the response behavior for the lowering of the cold filter plugging point ("CFPP") on addition of cold flow improvers.

The present invention further relates to a specific mixture composed of such components (A) and (B) and inert diluent which comprises a proportion of particular alkanols, phenols and/or carboxylic esters, and to the use of this specific mixture as a constituent of additive concentrates for middle distillate fuels.

Middle distillate fuels from fossil origin, especially gas oils, diesel oils or light heating oils, which are obtained from mineral oil have, according to the origin of the crude oil, different contents of paraffins, especially n-paraffins. At low temperatures, solid paraffins, which consist predominantly or exclusively of n-paraffins, begin to separate out at the cloud point ("CP"). In the course of further cooling, the platelet-shaped n-paraffin crystals form a kind of "house of cards structure" and the middle distillate fuel ceases to flow even though its predominant portion is still liquid. The precipitated n-paraffins considerably impair the free flow of the middle distillate fuels within the temperature range between the cloud point and the pour point ("PP"); the paraffins block filters and cause inhomogeneous or completely stopped fuel supply to the combustion units. Similar disruption occurs in the case of light heating oils.

It has been known for a long time that suitable additives can modify the crystal growth of the n-paraffins in middle distillate fuels. Additives with good efficacy prevent middle distillate fuels from already becoming solid at temperatures a few degrees Celsius below the temperature at which the first paraffin crystals crystallize out. Instead, fine, separate paraffin crystals which crystallize efficiently are formed, and pass through filters in motor vehicles and heating systems or at least form a filter cake which is permeable to the liquid portion of the middle distillates, such that disruption-free operation is ensured. The efficacy of the flow improvers, according to European standard EN 116, is expressed indirectly by measuring the cold filter plugging point ("CFPP").

Ethylene-vinyl carboxylate copolymers have been used for a long time as cold flow improvers or middle distillate flow improvers ("MDFIs"). One disadvantage of these additives is that the precipitated paraffin crystals, owing to their higher density compared to the liquid portion, tend to settle out more and more at the bottom of the vessel in the course of storage. As a result, a homogeneous low-paraffin phase forms in the upper part of the vessel, and a biphasic paraffin-rich layer at the bottom. Since the fuel is usually drawn off just above the vessel bottom both in vehicle tanks and in storage or delivery tanks of mineral oil dealers, there is the risk that the high concentrations of solid paraffins lead to blockages of filters and metering devices. The further the storage temperature goes below the deposition temperature of the paraffins—i.e. the cloud point—the greater this risk becomes, since the amount of paraffin deposited increases with falling temperature. More particularly, fractions of biodiesel can enhance this undesired tendency of the middle distillate fuel to sediment paraffins.

The additional use of cloud point depressants and/or paraffin dispersants allows these problems to be reduced. Especially the use of cloud point depressants allows the temperature range within which middle distillate fuels can be utilized without any problem to be widened toward lower temperatures.

In view of decreasing global mineral oil reserves and the discussion about the environmentally damaging consequences of the consumption of fossil and mineral fuels, there is increasing interest in alternative energy sources based on renewable raw materials. These include especially native oils and fats of vegetable or animal origin. These are especially triglycerides of fatty acids having 10 to 24 carbon atoms, which are converted to lower alkyl esters such as methyl esters. These esters are generally also referred to as "FAME" (fatty acid methyl ester). Mixtures of these FAMEs with middle distillates possess poorer cold performance than these middle distillates alone. More particularly, the addition of the FAMEs increases the tendency to form paraffin sediments.

WO 2007/147753 (1) describes a mixture of 5 to 95% by weight of at least one polar oil-soluble nitrogen compound which is capable of sufficiently dispersing paraffin crystals which have precipitated under cold conditions in fuels, 1 to 50% by weight of at least one oil-soluble acid amide formed from polyamines having 2 to 1000 nitrogen atoms and $C_8$- to $C_{30}$-fatty acids or fatty acid analogous compounds comprising free carboxyl groups, and 0 to 50% by weight of at least one oil-soluble reaction product of $\alpha,\beta$-dicarboxylic acids having 4 to 300 carbon atoms or derivatives thereof and primary alkylamines, and the use of this mixture as an additive to fuels for improving the cold flow performance, especially in the function as a paraffin dispersant. Both in middle distillate fuels which are entirely of fossil origin and in middle distillate fuels comprising biodiesel components, a lowering of the CP values and/or CFPP values in the fuel bottom phase after sedimentation is observed with this mixture. The CP and CFPP values are determined from the unsedimented overall fuel and in a short sedimentation test from the 20% by volume of bottom phase. The action of this mixture is illustrated explicitly only on German winter diesel fuels with CP values of the unadditized fuels of −5.9° C. to −7.4° C. (determined to ISO 3015), which remain unchanged after addition of this mixture (in the particular determination of the CP from the unsedimented fuel) and experience a decrease only in the fuel bottom phase after sedimentation. The polar oil-soluble nitrogen compounds specified in (1) are, for example, the reaction products of 1 mol of ethylenediaminetetraacetic acid and 4 mol of hydrogenated ditallow fatty amine, the reaction product of 1 mol of phthalic anhydride and 2 mol of hydrogenated or unhydrogenated ditallow fatty amine, or the reaction product of 1 mol of an alkenylspirobislactone with 2 mol of hydrogenated or unhydrogenated ditallow fatty amine. The mixture described in (1) can be added to the fuel undiluted or in a hydrocarbon solvent.

WO 2007/131894 (2) discloses cold-stabilized fuel oil compositions with a content of cold flow improvers, detergent additives and cold stabilization enhancers. A recommended cold stabilization enhancer is in particular the monoamide formed from maleic acid and tridecylamine. These cold stabilization enhancers especially lower again the CFPP and/or CP which has been raised or has not been lowered sufficiently by the detergent. The cold flow improvers mentioned are, for example, the reaction product of 1 mol of ethylenediaminetetraacetic acid and 4 mol of hydrogenated ditallow fatty amine, the reaction product of 1 mol of phthalic anhydride and 2 mol of hydrogenated or unhydrogenated ditallow fatty amine, or the reaction product of 1 mol of an alkenylspirobislactone with 2 mol of hydrogenated or unhydrogenated ditallow fatty amine. The fuel oil compositions described in (2) may, as well as further customary coadditives, comprise solubilizers not specified in detail among other substances.

WO 03/042336 (3) describes mixtures of an ester of an alkoxylated polyol and a polar nitrogen-containing paraffin dispersant, for example a reaction product of an alkenylspirobislactone with an amine, an amide or ammonium salt of an aminoalkylenepolycarboxylic acid such as ethylenediaminetetraacetic acid or nitrilotriacetic acid, or an amide of a dicarboxylic acid such as phthalic acid, as additives for low-sulfur mineral oil distillates. Solubilizers such as 2-ethylhexanol, decanol, isodecanol or isotridecanol can be added to these mixtures.

EP-A 1 746 147 (4) discloses copolymers which, as well as ethylenically unsaturated esters of dicarboxylic acids, comprise in copolymerized form at least one olefin and optionally the anhydride of an ethylenically unsaturated dicarboxylic acid as cloud point depressants for lowering the CP of fuel oils and lubricants.

It was an object of the present invention to provide products as higher-performance cloud point depressants, which ensure improved cold flowability performance of such middle distillate fuels which, before the addition of additives, already have a relatively low CP of −8.0° C. or less, by lowering the cloud point ("CP"), determined in the unsedimented middle distillate fuel, efficiently at customary dosages—i.e. by at least 1.5° C.—compared to the unadditized fuel, without a simultaneous deterioration in the response behavior for the lowering of the cold filter plugging point ("CFPP") on addition of cold flow improvers, as is the case at least for the cloud point depressants known from the prior art—as also described for those in document (4).

The object is achieved in accordance with the invention by the use, defined at the outset, of the mixture which comprises components (A) and (B).

The mixture of (A) and (B) preferably lowers the CP in the middle distillate fuel by at least 1.8° C., especially by at least 2.3° C., in particular by at least 2.6° C., compared to the unadditized middle distillate fuel at a dosage of the mixture in the range from 150 to 250 ppm by weight, in each case determined in the unsedimented middle distillate fuel, while the response behavior for the lowering of the CFPP in the case of preceding or subsequent additional addition of cold flow improvers such as customary MDFIs, for example ethylene-vinyl carboxylate copolymers, is not just not worsened but generally improved over the middle distillate fuel which comprises only the cold flow improvers, and normally by a further lowering of the CFPP values by at least 2° C., especially by at least 3° C., in particular by at least 4° C.

In contrast to the determination method, cited in the prior art, for the CP and CFPP values by short sedimentation tests and measurements from the 20% by volume of bottom phase—as described in (1) to (3)—the present invention bases the unsedimented overall middle distillate fuel on the measurement of the CP and CFPP values which are definitive in terms of performance, and thus reports CP values which have a strict upper limit for practical reasons and are relevant to refineries.

The oil-soluble polar nitrogen compounds of component (A) which—outside the context of the present invention, themselves alone—are capable of dispersing paraffin crystals which have precipitated under cold conditions in middle distillate fuels sufficiently, i.e. according to the practical requirements of the mineral oil industry, may be either ionic or nonionic in nature and preferably possess at least one and especially at least two aminic nitrogen radicals with a $C_8$- to $C_{40}$-hydrocarbon radical in each case as a substituent on the nitrogen atom. These nitrogen radicals may also be present in quaternized form, i.e. in cationic form. Examples of such nitrogen compounds are ammonium salts and/or amides, which are obtainable by the reaction of at least one amine substituted by at least one hydrocarbon radical with a carboxylic acid having 1 to 4 carboxyl groups or with a suitable derivative thereof. The amines preferably comprise at least one linear $C_8$- to $C_{40}$-alkyl radical.

In a preferred embodiment, the inventive mixture comprises, as component (A), at least one oil-soluble polar nitrogen compound selected from (A1) reaction products of an aromatic or cycloaliphatic dicarboxylic acid or of a succinic acid substituted by $C_8$- to $C_{30}$-hydrocarbon radicals with 2 mol of primary or secondary amines having at least 8 carbon atoms, (A2) reaction products of poly($C_2$- to $C_{20}$-carboxylic acid) having at least one tertiary amino group with primary or secondary amines having at least 8 carbon atoms, (A3) reaction products of 1 mol of an alkenylspirobislactone with 2 mol of primary or secondary amines having at least 8 carbon atoms and (A4) reaction products of 1 mol of a terpolymer of α,β-unsaturated dicarboxylic anhydrides, α-olefins and polyoxyalkylene ethers of unsaturated alcohols with 2 mol of primary or secondary amines having at least 8 carbon atoms.

As component (A), it is also possible for mixtures of a plurality of different representatives in each case from group (A1), group (A2) or group (A3) to occur. It is also possible for a mixture of representatives from different groups, i.e., for example, from (A1) and (A2), from (A1) and (A3), from (A1) and (A4), from (A2) and (A3), from (A2) and (A4), from (A3) and (A4), from (A1) and (A2) and (A3), from (A1) and (A2) and (A4), from (A1) and (A3) and (A4), from (A2) and (A3) and (A4), and from (A1) and (A2) and (A3) and (A4).

A single representative from (A1) or a mixture of different reaction products from (A1) is particularly preferred here.

The preferred component (A1) comprises reaction products of dicarboxylic acids such as cyclohexane-1,2-dicarboxylic acid, cyclohexene-1,2-dicarboxylic acid, cyclopentane-1,2-dicarboxylic acid, naphthalenedicarboxylic acids such as naphthalene-1,2-dicarboxylic acid, naphthalene-1,4-dicarboxylic acid, naphthalene-1,5-dicarboxylic acid and naphthalene-1,8-dicarboxylic acid, phthalic acid, isophthalic acid, terephthalic acid, and succinic acids substituted by long-chain hydrocarbon radicals such as octyl, 2-ethylhexyl, nonyl, isononyl, decyl, 2-propylheptyl, undecyl, dodecyl, tridecyl, isotridecyl, tetradecyl, hexadecyl, octadecyl or eicosyl. In this context, the aromatic dicarboxylic acids listed are particularly preferred.

The primary and secondary amines having at least 8 carbon atoms as the particular reaction partner for the polycarboxylic acids or alkenylspirobislactones to form the component (A1), (A2) and (A3) are typically monoamines, especially aliphatic monoamines. These primary and secondary amines may be selected from a multitude of amines which bear hydrocarbon radicals—optionally joined to one another. In a preferred embodiment, these amines are secondary amines and have the general formula $HNR_2$ in which the two R variables are each independently straight-chain or branched $C_8$- to $C_{30}$-alkyl or -alkenyl radicals, especially $C_{14}$- to $C_{24}$-alkyl radicals, in particular $C_{16}$- to $C_{20}$-alkyl radicals. These relatively long-chain alkyl or alkenyl radicals are preferably straight-chain or branched only to a minor degree. In general, the secondary amines mentioned, with regard to their relatively long-chain alkyl and alkenyl radicals, derive from naturally occurring fatty acids or from derivatives thereof. The two R radicals are preferably the same. Suitable primary amines are, for example, octylamine, 2-ethylhexylamine, nonylamine, decylamine, 2-propylheptyl, undecylamine, dodecylamine, tridecylamine, isotridecylamine, tetradecylamine, hexadecylamine, octadecylamine (stearylamine), oleylamine or behenylamine. Suitable secondary amines are, for example, dioctadecylamine (distearylamine) and methylbehenylamine. Also suitable are amine mixtures, especially amine mixtures obtainable on the industrial scale, such as fatty amines or hydrogenated or unhydrogenated tallow amines, for example hydrogenated or unhydrogenated tallow fatty amine, as described, for example, in Ullmanns Encyclopedia of Industrial Chemistry, 6th edition, in the chapter "Amines, aliphatic".

Incidentally, the abovementioned long-chain secondary amines such as distearylamine may also, in free form, i.e. not having been reacted with a carboxyl function, be part of mixtures suitable as additive concentrates for middle distillate fuels.

Typical examples of component (A1) include the N,N-dialkylammonium salts of 2-N',N'-dialkylamidobenzoates, for example the reaction product of 1 mol of phthalic anhydride and 2 mol of ditallow fatty amine, in which case the latter may be hydrogenated or unhydrogenated.

The poly($C_2$- to $C_{20}$-carboxylic acids) which have at least one tertiary amino group and form the basis of the preferred component (A2) comprise preferably at least 3 carboxyl groups, especially 3 to 12, in particular 3 to 5 carboxyl groups. The carboxylic acid units in the polycarboxylic acids have preferably 2 to 10 carbon atoms, especially acetic acid units. The carboxylic acid units are joined to the polycarboxylic acids in a suitable manner, for example via one or more carbon and/or nitrogen atoms. They are preferably attached to tertiary nitrogen atoms which, in the case of a plurality of nitrogen atoms, are bonded via hydrocarbon chains.

The poly($C_2$- to $C_{20}$-carboxylic acids) forming the basis of the preferred component (A2) are especially a compound of the general formula I or II

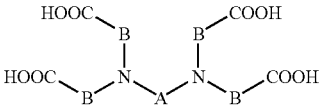

(I)

-continued

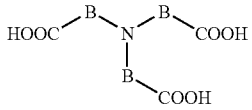

(II)

in which the A variable is a straight-chain or branched $C_2$- to $C_6$-alkylene group or the moiety of the formula III

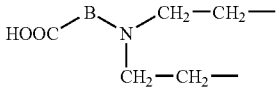

(III)

and the variable B denotes a $C_1$- to $C_{19}$-alkylene group.

Straight-chain or branched $C_2$- to $C_6$-alkylene groups of the A variables are, for example, 1,1-ethylene, 1,2-propylene, 1,3-propylene, 1,2-butylene, 1,3-butylene, 1,4-butylene, 2-methyl-1,3-propylene, 1,5-pentylene, 2-methyl-1,4-butylene, 2,2-dimethyl-1,3-propylene, 1,6-hexylene (hexamethylene) and especially 1,2-ethylene. The A variable preferably comprises 2 to 4 and especially 2 or 3 carbon atoms.

$C_1$- to $C_{19}$-alkylene groups of the B variables are, for example, 1,2-ethylene, 1,3-propylene, 1,4-butylene, hexamethylene, octamethylene, decamethylene, dodecamethylene, tetradecamethylene, hexadecamethylene, octadecamethylene, nonadecamethylene and especially methylene. The B variable preferably comprises 1 to 10 and especially 1 to 4 carbon atoms.

Typical examples of component (A2) are reaction products of nitrilotriacetic acid, of ethylenediaminetetraacetic acid or of propylene-1,2-diaminetetraacetic acid with in each case 0.5 to 1.5 mol per carboxyl group, especially 0.8 to 1.2 mol per carboxyl group, of dioleylamine, dipalmitinamine, dicocoamine, distearylamine, dibehenylamine or especially ditallowamine. A particularly preferred component (A2) is the reaction product of 1 mol of ethylenediaminetetraacetic acid and 4 mol of hydrogenated ditallowamine.

A typical example of component (A3) is the reaction product of 1 mol of an alkenylspirobislactone with 2 mol of a dialkylamine, for example ditallowamine and/or tallowamine, in which case the latter two substances may be hydrogenated or unhydrogenated.

A typical example of component (A4) is the reaction product of 1 mol of a terpolymer of maleic anhydride, an α-olefin having 10 to 30 carbon atoms and an allylpolyglycol with 2 mol of a dialkylamine, for example ditallowamine and/or tallowamine, in which case the latter two substances may be hydrogenated or unhydrogenated.

Moreover, the oil-soluble polar nitrogen compounds (A1), (A2), (A3) and (A4), in a preferred embodiment, are amides, amide ammonium salts or ammonium salts in which no, one or more carboxylic acid groups has/have been converted to amide groups. The abovementioned secondary amines may be bonded to the polycarboxylic acids by means of amide structures or in the form of the ammonium salts; it is also possible for only a portion to be present in the form of amide structures and another portion in the form of ammonium salts. Preferably only few or no free acid groups are present. Such reaction products of dicarboxylic acids with secondary amines are preferably present in the form of mixed amide ammonium salts.

The parent carboxylic acid units of the oil-soluble aliphatic compounds of component (B) are preferably aliphatic mono- or dicarboxylic acids having 4 to 75 and especially 4 to 30 carbon atoms. With regard to the position of the two carboxyl functions, the dicarboxylic acids mentioned typically have an α,β structure. The parent monoamines of component (B) may be primary or secondary monoamines which have 1 to 30 carbon atoms and whose hydrocarbon radicals are alkyl, alkenyl or cycloalkyl substituents. The parent polyamines of component (B) may be those having 2 to 1000, especially 2 to 500 and in particular 2 to 100 nitrogen atoms in the molecule; useful hydrocarbon radicals and bridging members here preferably include, respectively, alkyl and alkenyl radicals, and alkylene and alkenylene radicals. The parent alcohols may be aliphatic or cycloaliphatic mono-, di- or polyalcohols having 1 to 30 carbon atoms. The oil-soluble aliphatic compounds of component (B) are thus generally carboxamides, carboxylic monoamides, carboximides or carboxylic esters. In each case, at least one unit in component (B)—whether it be the carboxylic acid unit, the amine unit or the alcohol unit—must have one or more straight-chain or branched alkyl or alkenyl chains having at least 8, especially 14 and in particular 16 carbon atoms.

In a preferred embodiment, the at least one oil-soluble aliphatic compound (B) is selected from (B1) reaction products of aliphatic α,β-dicarboxylic acids having 4 to 300 carbon atoms or derivatives thereof with primary $C_8$- to $C_{30}$-alkyl- or -alkenylmonoamines and (B2) oil-soluble acid amides formed from polyamines having 2 to 1000 nitrogen atoms and $C_8$- to $C_{30}$-fatty acids or fatty acid analogous compounds comprising free carboxyl groups.

The parent α,β-dicarboxylic acids of the oil-soluble reaction products of component (B1), which have 4 to 300, especially 4 to 75, and in particular 4 to 12 carbon atoms, are especially succinic acid, maleic acid, fumaric acid or derivatives thereof, which may have, on the bridging ethylene or ethenylene group, relatively short-chain or relatively long-chain hydrocarbyl substituents which may comprise or bear heteroatoms and/or functional groups. For the reaction with the primary alkyl- or alkenylamines, they are generally used in the form of the free dicarboxylic acid or of the reactive derivatives thereof. The reactive derivatives used here may be carbonyl halides, carboxylic esters or especially carboxylic anhydrides.

In a preferred embodiment, the oil-soluble aliphatic compound (B1) is a reaction product of maleic anhydride and primary $C_9$- to $C_{15}$-alkylamines.

The parent primary alkylamines of the oil-soluble reaction products of component (B1) are typically medium-chain to long-chain alkyl- or alkenylmonoamines having preferably 8 to 30, especially 8 to 22 and in particular 9 to 15 carbon atoms and a linear or branched, saturated or unsaturated aliphatic hydrocarbon chain, for example octyl-, nonyl-, isononyl-, decyl-, undecyl-, tridecyl-, isotridecyl-, tetradecyl-, pentadecyl-, hexadecyl-, heptadecyl-, octadecyl- or oleylamine, and mixtures of such amines. If the primary alkyl- or alkenylamines of this kind used are naturally occurring fatty amines, suitable examples are in particular cocoamine, tallowamine, oleylamine, arachidylamine or behenylamine and mixtures thereof. The reaction products of component (B1) are typically—according to the stoichiometry and reaction regime—present in the form of monoamides or bisamides of the dicarboxylic acid; they may also comprise a minor amount of corresponding ammonium salts.

A typical example of an oil-soluble reaction product of component (B1) is the reaction product of 1 mol of maleic anhydride with 1 mol of isotridecylamine, which is present predominantly as the monoamide of maleic acid.

The parent polyamines of the oil-soluble acid amides of component (B2) may either be structurally clearly defined low molecular weight "oligo" amines or polymers having up to 1000, especially up to 500 and in particular up to 100 nitrogen atoms in the macromolecule. The latter are then typically polyalkylenimines, for example polyethylenimines, or polyvinylamines.

The polyamines mentioned are reacted with $C_8$- to $C_{30}$-fatty acids, especially $C_{16}$- to $C_{20}$-fatty acids, or fatty acid analog compounds comprising free carboxyl groups to give the oil-soluble acid amides (B2). Instead of the free fatty acids, it is in principle also possible to use reactive fatty acid derivatives such as the corresponding esters, halides or anhydrides for the reaction.

The reaction of polyamines with the fatty acid to give the oil-soluble acid amides of component (B2) proceeds to completion or partially. In the latter case, usually minor amounts of the product are typically present in the form of corresponding ammonium salts. The completeness of the conversion to the acid amides can generally be controlled, however, through the reaction parameters.

Examples of polyamines suitable for the conversion to the acid amides of component (B2) include: ethylenediamine, diethylenetriamine, triethylenetetramine, tetraethylenepentamine, pentaethylenehexamine, dipropylenetriamine, tripropylenetetramine, tetrapropylenepentamine, pentapropylenehexamine, polyethylenimines of a mean degree of polymerization (corresponding to the number of nitrogen atoms) of, for example, 10, 35, 50 or 100, and polyamines which have been obtained by reaction of oligoamines (with chain extension) with acrylonitrile and subsequent hydrogenation, for example N,N'-bis(3-aminopropyl)ethylenediamine.

Useful fatty acids suitable for the conversion to the acid amides of component (B2) include pure fatty acids and industrially customary fatty acid mixtures, which comprise, for example, stearic acid, palmitic acid, lauric acid, oleic acid, linoleic acid and/or linolenic acid. Of particular interest in this context are naturally occurring fatty acid mixtures, for example tallow fatty acid, coconut oil fatty acid, fish oil fatty acid, coconut palm kernel oil fatty acid, soybean oil fatty acid, colza oil fatty acid, peanut oil fatty acid or palm oil fatty acid, which comprise oleic acid and palmitic acid as main components.

Examples of fatty acid analog compounds which comprise free carboxyl groups and are likewise suitable for reaction with the polyamines mentioned to give the acid amides of component (B2) are monoesters of long-chain alcohols of dicarboxylic acids such as tallow alcohol maleic monoesters or tallow alcohol succinic monoesters, or corresponding glutaric or adipic monoesters.

In a preferred embodiment, the oil-soluble aliphatic compound (B2) is an oil-soluble acid amide formed from aliphatic polyamines with 2 to 6 nitrogen atoms and $C_{16}$- to $C_{20}$-fatty acids, all primary and secondary amino functions of the polyamines having been converted to acid amide functions.

A typical example of an oil-soluble acid amide of component (B2) is the reaction product of 3 mol of oleic acid with 1 mol of diethylenetriamine.

In a preferred embodiment, the mixture for use in accordance with the invention comprises, as components effective for the desired lowering of the cloud point in the middle distillate fuels, the two components (A1) and (B1) or the two components (A1) and (B2); the mixture used in accordance with the invention most preferably comprises, as components effective for the desired lowering of the cloud point in the middle distillate fuels, the three components (A1), (B1) and (B2).

In a further preferred embodiment, the mixture used in accordance with the invention comprises, as an additional component, at least one inert polar diluent (C) selected from $C_8$- to $C_{30}$-alkanols, aryl-substituted $C_1$- to $C_6$-alkanols, $C_6$- to $C_{20}$-phenols, monoalkyl monocarboxylates having at least one hydrocarbyl chain having 8 to 30 carbon atoms and dialkyl dicarboxylates having at least one hydrocarbyl chain having 8 to 30 carbon atoms in an amount effective for the further lowering of the cloud point. This is because such inert polar diluents in many cases, in the case of combination with components (A) and (B), bring about a further lowering or an enhanced lowering of the cloud point in middle distillate fuels without any deterioration in the response behavior for the lowering of the cold filter plugging point on addition of cold flow improvers.

Examples of useful $C_8$- to $C_{30}$-alkanols for component (C) include: n-octanol, 2-ethylhexanol, n-nonanol, isononanol, n-decanol, 2-propylheptanol, n-undecanol, n-dodecanol, n-tridecanol, isotridecanol, n-tetradecanol, n-pentadecanol, n-hexadecanol, n-heptadecanol, n-octadecanol, n-nonadecanol and eicosanol. Among these, particularly good action is exhibited by the branched alcohols 2-ethylhexanol, isononanol, 2-propylheptanol, isotridecanol, and the linear alkanols n-heptadecanol and n-octadecanol.

Examples of useful aryl-substituted $C_1$ to $C_6$-alkanols for component (C) include: benzyl alcohol, 2-phenylethanol, 3-phenylpropanol, 4-phenylbutanol and 6-phenylhexanol.

Examples of useful $C_6$- to $C_{20}$-phenols for component (C) include: unsubstituted phenol, α-naphthol, β-naphthol, o-, m- and p-cresol, 2-tert-butylphenol, 4-tert-butylphenol, 2,4-di-tert-butylphenol and 2,6-di-tert-butylphenol.

Useful monoalkyl monocarboxylates having at least one hydrocarbyl chain having 8 to 30 carbon atoms for component (C) include firstly esters of relatively short-chain carboxylic acids and relatively long-chain alcohols, for example the n-octyl, 2-ethylhexyl, n-nonyl, isononyl, n-decyl, 2-propylheptyl, n-undecyl, n-dodecyl, n-tridecyl, isotridecyl, n-tetradecyl, n-pentadecyl, n-hexadecyl, n-heptadecyl, n-octadecyl, n-nonadecyl and eicosyl esters of formic acid, acetic acid, propionic acid, butyric acid, isobutyric acid, valeric acid, cyclohexanecarboxylic acid and benzoic acid. In this case, the carboxylic acid unit has preferably 1 to 12, especially 1 to 8 and in particular 1 to 6 carbon atoms. Particularly good action is exhibited here by the esters of $C_4$- to $C_6$-monocarboxylic acids with the branched relatively long-chain alkanols 2-ethylhexanol, isononanol, 2-propylheptanol and isotridecanol.

Additionally useful as monoalkyl monocarboxylates having at least one hydrocarbyl chain having 8 to 30 carbon atoms for component (C) are secondly esters of relatively long-chain carboxylic acids and relatively short-chain alcohols, for example the methyl, ethyl, n-propyl, isopropyl, n-butyl, isobutyl, sec-butyl and tert-butyl esters of $C_{12}$- to $C_{20}$-fatty acids. In this context, both pure fatty acids and industrially customary fatty acid mixtures are useful, said mixtures comprising, for example, stearic acid, palmitic acid, lauric acid, oleic acid, linoleic acid and/or linolenic acid, for example the mixtures tallow fatty acid, coconut oil fatty acid, fish oil fatty acid, coconut palm kernel oil fatty acid, soybean oil fatty acid, colza oil fatty acid, peanut oil fatty acid or palm oil fatty acid, which comprise oleic acid and palmitic acid as main component. The sunflower methyl esters, palm oil methyl esters ("PME"), soybean oil methyl esters ("SME") or rapeseed oil methyl esters ("RME") which find use as biodiesel or biodiesel components can likewise be used here Examples of useful dialkyl dicarboxylates having at least one hydrocarbyl chain having 8 to 30 carbon atoms for component (C) include: the di-n-octyl, di-2-ethylhexyl, di-n-nonyl, di-isononyl, di-n-decyl, di-2-propylheptyl, di-n-undecyl, di-n-dodecyl, di-n-tridecyl, di-isotridecyl, di-n-tetradecyl, di-n-pentadecyl, di-n-hexadecyl, di-n-heptadecyl, di-n-octadecyl, di-n-nonadecyl and dieicosyl esters of oxalic acid, malonic acid, succinic acid, fumaric acid, maleic acid, glutaric acid, adipic acid, pimelic acid, suberic acid, azeleic acid, sebacic acid, cyclohexane-1,2-dicarboxylic acid, cyclohexane-1,3-dicarboxlic acid, cyclohexane-1,4-dicarboxylic acid, phthalic acid, isophthalic acid and terephthalic acid. The dicarboxylic acid unit here preferably has 2 to 20, especially 2 to 12 and in particular 2 to 8 carbon atoms. The two ester alcohol units may also be different, but are preferably the same. Particularly good action is exhibited here by the diesters of $C_4$- to $C_6$-dicarboxylic acids with the branched alkanols 2-ethylhexanol, isononanol, 2-propylheptanol and isotridecanol. A typical example of such a dicarboxylic diester is diisononyl cyclohexane-1,2-dicarboxylate.

A "hydrocarbyl chain" shall be understood here to mean a linear or branched structural element in the esters mentioned, which is formed essentially from carbon and hydrogen. Provided that its predominant hydrocarbon character is not impaired, the hydrocarbyl chain may, to a minor degree, comprise hetero atoms such as oxygen, nitrogen and/or sulfur or bear functional groups such as hydroxyl or amino. It is also possible for unsaturations such as ethylenic double bonds and/or C═N bonds to occur. This hydrocarbyl chain is the backbone of the monocarboxylic acid or of the ester alcohol, or the bridging unit between two carboxylic acid functions.

In addition to the inert polar diluents (C) mentioned, it is also possible for inert nonpolar diluents (D) to be present in the mixture used in accordance with the invention. The proportion of inert polar diluents (C) in the total amount of the inert diluents—i.e. the sum of (C) and (D)—should, when one is used, be at least 20% by weight, especially at least 40% by weight, in particular at least 50% by weight. Such inert nonpolar diluents here include especially aliphatic and aromatic hydrocarbons, for example xylenes or mixtures of high-boiling aromatics such as Solvent Naphtha. It is also possible here to use middle distillate fuels themselves as diluents.

The mixture used in accordance with the invention comprises the components mentioned preferably in the following quantitative ratios:

- 5 to 60% by weight, especially 10 to 50% by weight, in particular 20 to 40% by weight, of component (A), especially of component (A1),
- 3 to 70% by weight, especially 10 to 40% by weight, in particular 15 to 30% by weight, of component (B), especially of components (B1) and/or (B2),
- 0 to 75% by weight, especially 5 to 75% by weight, in particular 30 to 60% by weight, of the sum of components (C)+(D), where the sum of all components mentioned adds up to 100% by weight.

The mixture in accordance with the invention can be prepared by simply mixing the components mentioned without supplying heat—without or with diluent (C) and/or (D).

The mixture used in accordance with the invention serves, in the function as a cloud point depressant, as an additive to middle distillate fuels which, before the addition of additives, already have a relatively low CP of −8.0° C. or lower, in particular of −10.0° C. or lower, for lowering the cloud point, without simultaneously worsening the response behavior for the lowering of the cold filter plugging point on addition of cold flow improvers. Middle distillate fuels, which find use especially as gas oils, petroleum, diesel oils (diesel fuels) or light heating oils, are often also referred to as fuel oils. Such middle distillate fuels generally have boiling temperatures of 150 to 400° C.

The mixture used in accordance with the invention can be added to the middle distillate fuels without or with the above-mentioned diluents. The dosage of the mixture of the components effective for lowering the cloud point, i.e. of components (A) and (B) or (A), (B) and (C), in the middle distillate fuels is generally 5 to 10 000 ppm by weight, especially 10 to 5000 ppm by weight, in particular 25 to 1000 ppm by weight, for example 50 to 400 ppm by weight, based in each case on the total amount of middle distillate fuel.

The mixture used in accordance with the invention can be used to lower the cloud point in the context of the present invention in middle distillate fuels which are purely of fossil origin, i.e. have been produced entirely from crude oil, or else in middle distillate fuels which consist (E) to an extent of 0.1 to 75% by weight, preferably to extent of 0.5 to 50% by weight, especially to an extent of 1 to 25% by weight, in particular to an extent of 3 to 12% by weight, of at least one biofuel oil based on fatty acid esters, and (F) to an extent of 25 to 99.9% by weight, preferably to an extent of 50 to 99.5% by weight, especially to an extent of 75 to 99% by weight, in particular to an extent of 88 to 97% by weight, of middle distillates of fossil origin and/or of vegetable and/or animal origin, which constitute essentially hydrocarbon mixtures and are free of fatty acid esters.

The fuel component (E) is usually also referred to as "biodiesel". The middle distillates of the fuel component (E) are preferably essentially alkyl esters of fatty acids which derive from vegetable and/or animal oils and/or fats. Alkyl esters are typically understood to mean lower alkyl esters, especially $C_1$- to $C_a$-alkyl esters, which are obtainable by transesterifying the glycerides which occur in vegetable and/or animal oils and/or fats, especially triglycerides, by means of lower alcohols, for example ethanol, n-propanol, isopropanol, n-butanol, isobutanol, sec-butanol, tert-butanol or in particular methanol ("FAME").

Examples of vegetable oils which can be converted to corresponding alkyl esters and can thus serve as the basis of biodiesel are castor oil, olive oil, peanut oil, palm kernel oil, coconut oil, mustard oil, cottonseed oil and especially sunflower oil, palm oil, soybean oil and rapeseed oil. Further examples include oils which can be obtained from wheat, jute, sesame and shea tree nut; it is also possible to use arachis oil, jatropha oil and linseed oil. The extraction of these oils and their conversion to the alkyl esters are known from the prior art or can be derived therefrom.

It is also possible to convert already used vegetable oils, for example used deep fat fryer oil, if appropriate after appropriate cleaning, to alkyl esters and thus for them to serve as the basis for biodiesel.

Vegetable fats can in principle likewise be used as a source for biodiesel, but play a minor role.

Examples of animal fats and oils which are converted to corresponding alkyl esters and can thus serve as the basis of biodiesel are fish oil, bovine tallow, porcine tallow and similar fats and oils obtained as wastes in the slaughter or utilization of farm animals or wild animals.

The saturated or unsaturated fatty acids which underlie the vegetable and/or animal oils and/or fats mentioned, which usually have from 12 to 22 carbon atoms and may bear additional functional groups such as hydroxyl groups, and occur in the alkyl esters, are in particular lauric acid, myristic acid, palmitic acid, stearic acid, oleic acid, linolic acid, linolenic acid, elaidic acid, erucic acid and ricinolic acid, especially in the form of mixtures of such fatty acids.

Typical lower alkyl esters based on vegetable and/or animal oils and/or fats, which find use as biodiesel or biodiesel components, are, for example, sunflower methyl ester, palm oil methyl ester ("PME"), soybean oil methyl ester ("SME") and in particular rapeseed oil methyl ester ("RME").

However, it is also possible to use the monoglycerides, diglycerides and especially triglycerides themselves, for example caster oil, or mixtures of such glycerides, as biodiesel or components for biodiesel.

In the context of the present invention, the fuel component (F) shall be understood to mean middle distillate fuels boiling in the range from 120 to 450° C. Such middle distillate fuels are used in particular as diesel fuel, heating oil or kerosene, particular preference being given to diesel fuel and heating oil.

Middle distillate fuels refer to fuels which are obtained by distilling crude oil and boil within the range from 120 to 450° C. Preference is given to using low-sulfur middle distillate fuels, i.e. those which comprise less than 350 ppm by weight of sulfur, especially less than 200 ppm by weight of sulfur, in particular less than 50 ppm by weight of sulfur. In a preferred embodiment of the present invention, the sulfur content of the middle distillate fuels used is not more than 15 ppm by weight, especially not more than 10 ppm by weight; such middle distillate fuels are also referred to as "sulfur-free". They are generally crude oil distillates which have been subjected to refining under hydrogenation conditions and which therefore comprise only small proportions of polyaromatic and polar compounds. They are preferably those middle distillate fuels which have 95% distillation points below 370° C., in particular below 350° C. and in special cases below 330° C.

Low-sulfur and sulfur-free middle distillate fuels may be obtained from relatively heavy crude oil fractions which cannot be distilled under atmospheric pressure. Typical conversion processes for preparing middle distillate fuels from heavy crude oil fractions include: hydrocracking, thermal cracking, catalytic cracking, coking processes and/or visbreaking. Depending on the process, these middle distillate fuels are obtained in low-sulfur or sulfur-free form, or are subjected to refining under hydrogenating conditions.

The middle distillate fuels preferably have aromatics contents of below 28% by weight, especially below 20% by weight. The content of normal paraffins is between 5% by weight and 50% by weight, preferably between 10 and 35% by weight.

The middle distillate fuels referred to as fuel component (F) shall also be understood here to mean middle distillates which can either be derived indirectly from fossil sources such as mineral oil or natural gas, or else can be prepared from biomass via gasification and subsequent hydrogenation. A typical example of a middle distillate fuel which is derived indirectly from fossil sources is the GTL ("gas-to-liquid") diesel fuel obtained by means of Fischer-Tropsch synthesis. A middle distillate is prepared from biomass, for example via the BTL ("biomass-to-liquid") process, and can either be used alone or in a mixture with other middle distillates as fuel component (F). The middle distillates also include hydrocarbons which are obtained by the hydrogenation of fats and fatty oils. They comprise predominantly n-paraffins. It is common to the middle distillate fuels mentioned that they are essentially hydrocarbon mixtures and are free of fatty acid esters.

The qualities of the heating oils and diesel fuels are laid down in more detail, for example, in DIN 51603 and EN 590

(cf. also Ullmann's Encyclopedia of Industrial Chemistry, 5th edition, volume A 12, p. 617 ff.).

The oil-soluble polar nitrogen compounds of component (A) which are present in the mixture used in accordance with the invention are known in middle distillate fuels principally in the function of paraffin dispersants ("WASAs"). Such oil-soluble polar nitrogen compounds often display their action as paraffin dispersants particularly efficiently only together with the customary cold flow improvers. The components (A) present in the mixture used in accordance with the invention also generally display their action for lowering the cloud point in the context of the invention particularly efficiently together with such cold flow improvers. More particularly, in the present invention, the response behavior for the lowering of the CFPP in the case of use of such cold flow improvers is not worsened; in most cases, it is even improved.

Cold flow improvers or middle distillate flow improvers ("MDFIs") shall be understood here to mean especially the additive classes listed below:

(G1) copolymers of ethylene with at least one further ethylenically unsaturated monomer;

(G2) comb polymers;

(G3) polyoxyalkylenes;

(G4) sulfocarboxylic acids or sulfonic acids or derivatives thereof;

(G5) poly(meth)acrylic esters

The MDFIs of the additive classes (G1) to (G5) mentioned are known to those skilled in the art and are incidentally described in detail WO 2007/147753 (1).

In the copolymers of ethylene with at least one further ethylenically unsaturated monomer of additive class (G1), which is the most important here, the monomer is preferably selected from alkenylcarboxylic esters, (meth)acrylic esters and olefins.

Suitable olefins for this purpose are, for example, those having 3 to 10 carbon atoms and having 1 to 3 and preferably having 1 or 2 carbon-carbon double bonds, especially having one carbon-carbon double bond. In the latter case, the carbon-carbon double bond may be arranged either terminally ($\alpha$-olefins) or internally. However, preference is given to $\alpha$-olefins, particular preference to $\alpha$-olefins having from 3 to 6 carbon atoms, for example propene, 1-butene, 1-pentene and 1-hexene.

Suitable (meth)acrylic esters are, for example, esters of (meth)acrylic acid with $C_1$- to $C_{10}$-alkanols, especially with methanol, ethanol, propanol, isopropanol, n-butanol, sec-butanol, isobutanol, tert-butanol, pentanol, hexanol, heptanol, octanol, 2-ethylhexanol, nonanol, 2-propylheptanol and decanol.

Suitable alkenyl carboxylates are, for example, the vinyl and propenyl esters of carboxylic acids having 2 to 20 carbon atoms, whose hydrogen radical may be linear or branched. Among these, preference is given to the vinyl esters. Among the carboxylic acids having a branched hydrocarbon radical, preference is given to those whose branch is in the $\alpha$-position to the carboxyl group, the $\alpha$-carbon atom more preferably being tertiary, i.e. the carboxylic acid being a so-called neo-carboxylic acid. However, the hydrocarbon radical of the carboxylic acid is preferably linear.

Examples of suitable alkenyl carboxylates are vinyl acetate, vinyl propionate, vinyl butyrate, vinyl 2-ethylhexanoate, vinyl neopentanoate, vinyl hexanoate, vinyl neononanoate, vinyl neodecanoate, and the corresponding propenyl esters, preference being given to the vinyl esters. A particularly preferred alkenyl carboxylate is vinyl acetate; typical copolymers of additive class (G1) resulting therefrom are ethylene-vinyl acetate copolymers ("EVA"), which are used to a large extent in diesel fuels.

The ethylenically unsaturated monomer is copolymerized in the copolymer of additive class (G1) in an amount of preferably 1 to 50 mol %, especially 10 to 50 mol % and in particular 5 to 20 mol %, based on the overall copolymer.

The copolymer of additive class (G1) preferably has a number-average molecular weight $M_n$ of 1000 to 20 000, more preferably 1000 to 10 000 and especially preferably 1000 to 6000.

Comb polymers of additive class (G2) are, for example, those described in "Comb-Like Polymers, Structure and Properties", N. A. Platé and V. P. Shibaev, J. Poly. Sci. Macromolecular Revs. 8, pages 117 to 253 (1974). Typical comb polymers usable here are obtainable, for example, by the copolymerization of maleic anhydride or fumaric acid with another ethylenically unsaturated monomer, for example with an $\alpha$-olefin or an unsaturated ester, such as vinyl acetate, and subsequent esterification of the anhydride or acid function with an alcohol having at least 10 carbon atoms. Further usable comb polymers are copolymers of $\alpha$-olefins and esterified comonomers, for example esterified copolymers of styrene and maleic anhydride or esterified copolymers of styrene and fumaric acid. Also suitable are mixtures of comb polymers. Comb polymers may also be polyfumarates or polymaleates. Homo- and copolymers of vinyl ethers are also suitable comb polymers.

Suitable polyoxyalkylenes of additive class (G3) are, for example polyoxyalkylene esters, ethers, ester/ethers and mixtures thereof. The polyoxyalkylene compounds preferably comprise at least one, more preferably at least two, linear alkyl group(s) each having 10 to 30 carbon atoms and a polyoxyalkylene group having a number-average molecular weight of up to 5000. The alkyl group of the polyoxyalkylene radical preferably comprises from 1 to 4 carbon atoms. Such polyoxyalkylene compounds are described, for example, in EP-A 061 895 and in U.S. Pat. No. 4,491,455. Preferred polyoxyalkylene compounds are polyethylene glycols and polypropylene glycols having a number-average molecular weight of 100 to 5000. Preferred polyoxyalkylenes are also polyoxyalkylene esters of fatty acids having 10 to 30 carbon atoms, such as stearic acid or behenic acid. Preferred polyoxyalkylene compounds are additionally diesters of fatty acids having 10 to 30 carbon atoms, preferably of stearic acid or behenic acid.

Suitable sulfocarboxylic acids or sulfonic acids or their derivatives of additive class (G4) are, for example, sulfocarboxylic acids or sulfonic acids and their derivatives, as described in EP-A-0 261 957.

Suitable poly(meth)acrylic esters of additive class (G5) are either homo- or copolymers of acrylic and methacrylic esters. Preference is given to copolymers of at least two different (meth)acrylic esters which differ in the esterified alcohol. If appropriate, the copolymer comprises a further, different copolymerized olefinically unsaturated monomer. The weight-average molecular weight of the polymer is preferably 50 000 to 500 000. A preferred polymer is a copolymer of methacrylic acid and methacrylic esters of saturated $C_{14}$- and $C_{15}$-alcohols, in which the acid groups have been neutralized with hydrogenated tallamine. Suitable poly(meth) acrylic esters are described, for example, in WO 00/44857.

In addition to the mixture used in accordance with the invention, in the presence of cold flow improvers from additive classes (G1) to (G5), the middle distillate fuels comprise the latter in an amount of typically 1 to 2000 ppm by weight, preferably from 5 to 1000 ppm by weight, especially from 10 to 750 ppm by weight and in particular from 50 to 500 ppm by weight, for example from 150 to 400 ppm by weight.

The present invention also provides a novel specific mixture of above-mentioned components which are effective for the lowering of the cloud point in middle distillate fuels. This specific mixture comprises:

(a1) 5 to 60% by weight, especially 10 to 50% by weight, in particular 20 to 40% by weight, of at least one oil-soluble reaction product (A1) of an aromatic or cycloaliphatic dicarboxylic acid or of a succinic acid substituted by $C_5$- to $C_{30}$-hydrocarbon radicals with 2 mol of primary or secondary amines having at least 8 carbon atoms, (b1) 3 to 40% by weight, especially 5 to 30% by weight, in particular 10 to 20% by weight, of at least one oil-soluble aliphatic reaction product (B1) of an aliphatic α,β-dicarboxylic acid having 4 to 300 carbon atoms or derivatives thereof with primary $C_8$- to $C_{30}$-alkyl- or -alkenylamines, (b2) 0 to 30% by weight, especially 1 to 20% by weight, in particular 3 to 10% by weight, of at least one oil-soluble aliphatic acid amide (B2) formed from polyamines having 2 to 1000 nitrogen atoms and $C_8$- to $C_{30}$-fatty acids or fatty acid analog compounds comprising free carboxyl groups, and (c/d) 5 to 75% by weight, especially 20 to 70% by weight, in particular 35 to 65% by weight, of at least one inert diluent which, as well as inert nonpolar diluent components (D), comprises to an extent of at least 20% by weight, based on the total amount of inert diluent, of at least one inert polar diluent (C) selected from $C_8$- to $C_{30}$-alkanols, monoalkyl monocarboxylates having at least one hydrocarbyl chain having 8 to 30 carbon atoms and dialkyl dicarboxylates having at least one hydrocarbyl chain having 8 to 30 carbon atoms, where the sum of all four components (a1), (b1), (b2) and (c/d) mentioned adds up to 100% by weight.

This inventive specific mixture is suitable as a constituent of additive concentrates for middle distillate fuels.

Furthermore, in addition to the lowering of the cloud point with the mixture used in accordance with the invention and with the inventive specific mixture, a series of further fuel properties can be improved. Merely by way of example, mention shall be made here of the additional effect as a corrosion stabilizer or the improvement in the oxidation stability. In the case of use in extremely low-sulfur or sulfur-free middle distillate fuels which comprise predominantly or solely component (F), the use of the mixture used in accordance with the invention and of the inventive specific mixture, especially in combination with cold flow improvers, may contribute to an improvement in lubricity. Lubricity is determined, for example, in the HFRR test to ISO 12156.

In the case of addition of the mixture used in accordance with the invention and of the inventive specific mixture to middle distillate fuels already having a relatively low CP of −8.0° C. or lower, which are of fossil origin, i.e. have been obtained from crude oil, or which, in addition to the proportion based on crude oil, comprise a proportion of biodiesel, a significant lowering of the CP values with no simultaneous deterioration in the response behavior for the lowering of the cold filter plugging point on addition of cold flow improvers is observed, irrespective of the origin or of the composition of this fuel. The mixture used in accordance with the invention and the inventive specific mixture have very good breadth of action.

In general, the middle distillate fuels mentioned or the additive concentrates for middle distillate fuels mentioned may also comprise, as further additives in amounts customary therefor, cold flow improvers (as described above), further paraffin dispersants, conductivity improvers, anticorrosion additives, lubricity additives, antioxidants, metal deactivators, antifoams, demulsifiers, detergents, cetane number improvers, dyes or fragrances or mixtures thereof. These further additives are—if they have not been addressed above—familiar to those skilled in the art and therefore need not be explained any further here.

The examples which follow are intended to illustrate the present invention without restricting it.

EXAMPLES

Components used for the mixture used in accordance with the invention or inventive specific mixture:

(a1): phthalic anhydride reacted with 2 mol of hydrogenated ditallowamine;

(a2) ethylenediaminetetraacetic acid reacted with 4 mol of hydrogenated ditallowamine;

(b1): maleic anhydride reacted with 1 mol of tridecylamime;

(b2): diethylenetriamine reacted with 3 mol of oleic acid;

(c1): 2-propylheptanol (c2): heptadecanol (c3): diisononyl cyclohexane-1,2-dicarboxylate (c4): 2,4-di-tert-butylphenol (c5): rapeseed oil methyl ester (d1): Solvent Naphtha 150

The preparation or the origin of the abovementioned components is known to those skilled in the art from the prior art, and there is therefore no need to go into any further detail here.

The abovementioned components were used to prepare the inventive specific mixtures M1 to M7, or those used in accordance with the invention, which are listed below in Table 1 (data in % by weight):

TABLE 1

| | M1 | M2 | M3 | M4 | M5 | M6 | M7 |
|---|---|---|---|---|---|---|---|
| (a1) | 30 | 30 | 30 | 30 | 30 | 30 | 0 |
| (a2) | 0 | 0 | 0 | 0 | 0 | 0 | 30 |
| (b1) | 15 | 15 | 15 | 15 | 15 | 15 | 15 |
| (b2) | 7 | 7 | 7 | 7 | 7 | 7 | 7 |
| (c1) | 0 | 24 | 0 | 0 | 0 | 0 | 0 |
| (c2) | 0 | 0 | 24 | 0 | 0 | 0 | 0 |
| (c3) | 0 | 0 | 0 | 24 | 0 | 0 | 0 |
| (c4) | 0 | 0 | 0 | 0 | 24 | 0 | 0 |
| (c5) | 0 | 0 | 0 | 0 | 0 | 24 | 0 |
| (d1) | 48 | 24 | 24 | 24 | 24 | 24 | 48 |

To determine the CP and CFPP values, the ultralow sulfur diesel fuel (DF1) characterized below, which is typical of the market in the USA, was used as the middle distillate fuel:

DF1:

CP (to ISO 3015): −10.4° C.

CFPP (to EN 116): −12° C.

density d15 (DIN 51577): 835.7 kg/$m^3$ initial boiling point (DIN 51751): 185° C., final boiling point: 354° C.

boiling range of the 90%-20% fraction: 105° C.

paraffin content (by GC): 21.1% by weight (of which 3.3% by weight>C19)

sulfur content: 10 ppm by weight

Description of the Test Method:

The fuel DF1 was admixed with in each case 200 ppm by weight of mixtures M1 to M7 (active substance content: in each case 104 ppm by weight), in each case at 40° C. with stirring, and then cooled to room temperature. The CP of these additized fuel samples was determined to ISO 3015, and the CFPP to EN 116, and the measurements—as already beforehand on the unadditized fuel DF1—were in each case undertaken on the unsedimented overall fuel (and not on a lower phase obtained in a short sedimentation test). For this purpose, the procedure was according to the two standards specified. The measurement accuracies and repeatabilities observed in this case were ±0.1° C. for the CP and ±1° C. for the CFPP.

Subsequently, in each case 750 ppm by weight of a 40% by weight solution of an MDFI which is customary on the market and is based on an ethylene-vinyl acetate copolymer in Solvent Naphtha 150 (active substance content: 300 ppm by weight) were added to some of the fuel samples, in order to examine the response behavior to the lowering of the CFPP. In all cases, the CP remained unchanged. The original CFPP without MDFI addition ("CFPP") and the particular new CFPP ("CFPP*") were determined.

The results obtained are listed in Table 2 below:

TABLE 2

| Mixture | CP [° C.] | CFPP [° C.] | CFPP * [° C.] |
|---|---|---|---|
| unadditized DF1 | −10.4 | −12 | |
| DF1 only with MDFI | −10.4 | | −27 |
| DF1 with MDFI + M1 | −12.7 | −12 | −31 |
| DF1 with MDFI + M2 | −13.0 | −12 | −30 |
| DF1 with MDFI + M3 | −13.4 | −13 | −32 |
| DF1 with MDFI + M4 | −13.0 | −12 | not determined |
| DF1 with MDFI + M5 | −12.4 | −12 | −31 |
| DF1 with MDFI + M6 | −12.2 | −13 | not determined |
| DF1 with MDFI + M7 | −13.1 | −12 | −30 |

The invention claimed is:

1. A mixture comprising:

(a1) 5 to 60% by weight of at least one oil-soluble reaction product (A1) of an aromatic or cycloaliphatic dicarboxylic acid or of a succinic acid substituted by $C_8$- to $C_{30}$-hydrocarbon radicals with 2 mol of primary or secondary amines having at least 8 carbon atoms, (b 1) 3 to 40% by weight of at least one oil-soluble aliphatic reaction product (B 1) of an aliphatic α,β-dicarboxylic acid having 4 to 300 carbon atoms or derivatives thereof with primary $C_8$- to $C_{30}$-alkyl- or -alkenylamines, (b2) 0 to 30% by weight of at least one oil-soluble aliphatic acid amide (B2) formed from polyamines having 2 to 1000 nitrogen atoms and $C_8$- to $C_{30}$-fatty acids or fatty acid analog compounds comprising free carboxyl groups, and (c/d) 5 to 75% by weight of at least one inert diluent which, as well as inert nonpolar diluent components (D), comprises to an extent of at least 20% by weight, based on the total amount of inert diluent, of at least one inert polar diluent (C) selected from the group consisting of $C_8$- to $C_{30}$-alkanols, aryl-substituted $C_1$- to $C_6$-alkanols, $C_6$- to $C_{20}$-phenols, monoalkyl monocarboxylates having at least one hydrocarbyl chain having 8 to 30 carbon atoms and dialkyl dicarboxylates having at least one hydrocarbyl chain having 8 to 30 carbon atoms, where the sum of components (a1), (b1), (b2) and (c/d) adds up to 100% by weight.

2. The mixture according to claim 1, further comprising a middle distillate fuel, wherein the mixture is present in the middle distillate fuel in an amount of 50 to 300 ppm by weight, the middle distillate fuel has a cloud point value of −8.0° C. or lower, the combination of the mixture and the middle distillate fuel has a cloud point value that is lower than, by at least 1.5° C, the middle distillate fuel.

3. The mixture according to claim 2, wherein the middle distillate fuel has a sulfur content of not more than 15 ppm by weight.

4. The mixture according to claim 1, further comprising at least one additional oil-soluble polar nitrogen compound (A) selected from the group consisting of (A2) reaction products of poly($C_2$- to $C_{20}$-carboxylic acid) having at least one tertiary amino group with primary or secondary amines having at least 8 carbon atoms, (A3) reaction products of 1 mol of an alkenylspirobislactone with 2 mol of primary or secondary amines having at least 8 carbon atoms, and (A4) reaction products of 1 mol of a terpolymer of α,β-unsaturated dicarboxylic anhydrides, α-olefins and polyoxyalkylene ethers of unsaturated alcohols with 2 mol of primary or secondary amines having at least 8 carbon atoms.

5. The mixture according to claim 4, wherein the oil-soluble polar nitrogen compounds (A1) to (A4) are amides, amide ammonium salts or ammonium salts in which no, one or more carboxylic acid groups has/have been converted to amide groups.

6. The mixture according to claim 4, wherein the primary or secondary amines which have at least 8 carbon atoms and have been converted to the oil-soluble polar nitrogen compounds (A) to (A4) are secondary amines of the formula $HNR_2$ in which both R variables are each independently straight-chain or branched $C_8$- to $C_{30}$-alkyl or -alkenyl radicals.

7. The mixture according to claim 1, wherein the oil-soluble aliphatic compound (B1) is a reaction product of maleic anhydride and primary $C_9$- to $C_{15}$-alkylamines.

8. The mixture according to claim 1, wherein the oil-soluble aliphatic compound (B2) is an oil-soluble acid amide formed from aliphatic polyamines having 2 to 6 carbon atoms and $C_{12}$- to $C_{20}$-fatty acids, all primary and secondary amino functions of the polyamines having been converted to acid amide functions.

9. The mixture according to claim 1, comprising 1 to 30% by weight of the at least one oil-soluble aliphatic acid amide (B2).

10. The mixture according to claim 2, wherein the mixture is present in the middle distillate fuel in an amount of 150 to 250 ppm and the combination of the mixture and the middle distillate fuel has a cloud point value that is lower than, by at least 1.8° C., the middle distillate fuel.

11. The mixture according to claim 2, wherein the mixture is present in the middle distillate fuel in an amount of 150 to 250 ppm and the combination of the mixture and the middle distillate fuel has a cloud point value that is lower than, by at least 2.3° C., the middle distillate fuel.

12. The mixture according to claim 2, wherein the mixture is present in the middle distillate fuel in an amount of 150 to 250 ppm and the combination of the mixture and the middle distillate fuel has a cloud point value that is lower than, by at least 2.6° C., the middle distillate fuel.

13. The mixture according to claim 2, wherein the middle distillate fuel comprises one or more cold flow improvers, and wherein the combination of the mixture and the middle distillate fuel comprising one or more cold flow improvers has a cold filter plugging point that is no higher than the cold filter plugging point of the middle distillate fuel comprising one or more cold flow improvers.

14. The mixture according to claim 2, wherein the middle distillate fuel comprises one or more cold flow improvers, and wherein the combination of the mixture and the middle distillate fuel comprising one or more cold flow improvers has a cold filter plugging point that is lower than, by at least 2° C., the cold filter plugging point of the middle distillate fuel comprising one or more cold flow improvers.

15. The mixture according to claim 2, wherein the middle distillate fuel comprises one or more cold flow improvers, and wherein the combination of the mixture and the middle distillate fuel comprising one or more cold flow improvers has a cold filter plugging point that is lower than, by at least 3° C., the cold filter plugging point of the middle distillate fuel comprising one or more cold flow improvers.

16. The mixture according to claim 2, wherein the middle distillate fuel comprises one or more cold flow improvers, and wherein the combination of the mixture and the middle distillate fuel comprising one or more cold flow improvers has a cold filter plugging point that is lower than, by at least 4° C., the cold filter plugging point of the middle distillate fuel comprising one or more cold flow improvers.

* * * * *